US006234868B1

(12) United States Patent
Easter et al.

(10) Patent No.: US 6,234,868 B1
(45) **Date of Patent: *May 22, 2001**

(54) APPARATUS AND METHOD FOR CONDITIONING A POLISHING PAD

(75) Inventors: William Graham Easter; John Albert Maze; Frank Miceli, all of Orlando, FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/303,172

(22) Filed: Apr. 30, 1999

(51) Int. Cl.[7] ..... B24B 7/22

(52) U.S. Cl. ..... 451/5; 451/288; 451/443; 451/72

(58) Field of Search ..... 451/444, 443, 451/72, 56, 288, 287, 21, 5, 41, 11

(56) References Cited

U.S. PATENT DOCUMENTS

| | | | | |
|---|---|---|---|---|
| 3,801,293 | * | 4/1974 | Kiser | 451/296 |
| 4,222,204 | * | 9/1980 | Benner | 451/508 |
| 5,584,751 | * | 12/1996 | Kobayashi et al. | 451/288 |
| 5,833,519 | * | 11/1998 | Moore | 451/443 |
| 5,876,266 | | 3/1999 | Miller et al. . | |
| 6,019,670 | * | 2/2000 | Cheng et al. | 451/56 |
| 6,059,638 | * | 5/2000 | Crevasse et al. | 451/41 |

* cited by examiner

*Primary Examiner*—Robert A. Rose
(74) *Attorney, Agent, or Firm*—Duane Morris & Heckscher LLP

(57) ABSTRACT

An apparatus and method for conditioning a polishing pad used in a chemical mechanical polishing (CMP) process. The polishing pad is conditioned by the application of a conditioning device to the surface of the rotating polishing pad. The amount of force which is applied to the conditioning device is directly controlled by a force control mechanism so as to make the conditioning process more consistent.

16 Claims, 4 Drawing Sheets

390
A1
380
300
330
337
331
NNNNNNNNNNNNN
340
370
312
332
310
SSSS

APPARATUS AND METHOD FOR CONDITIONING A POLISHING PAD

FIELD OF THE INVENTION

The present invention relates to a method and apparatus for conditioning polishing pads for polishing semiconductor wafers.

DESCRIPTION OF THE RELATED ART

Chemical mechanical polishing (CMP) is an essential process in the production of integrated circuits (ICs). CMP is used to refine the surfaces of semiconductor wafers during fabrication. This process, known as planarization, serves to remove any excess or unwanted material from the surface of the wafer, and thus allows more circuits to be created on each wafer. The polishing is typically accomplished by applying the semiconductor wafer to a rotating polishing pad. The wafer is typically attached to a stationary shaft which is driven against a rotating polishing platen which has the polishing pad affixed to its upper surface. In alternative configurations, the drive shaft and semiconductor wafer may also be rotated. In most conditioning processes, a slurry (i.e. chemical liquid) is added to the surface of the polishing pad in order to assist in the polishing process. The slurry usually contains a polishing agent, such as alumina or silica, as well as various other chemicals which serve to etch or oxidize specific portions of the wafer during polishing.

A principal problem which occurs during the polishing process is the phenomenon known as "glazing." Glazing occurs when abrasive particles from the polishing slurry and the semiconductor wafers become embedded in the surface of the polishing pad. Often glazing results in a significant reduction in the efficiency of the polishing pad.

In addition to glazing, the polishing pad also often becomes worn in certain areas due to extended use. This wear also impacts on the effectiveness of the polishing process. Since the slurry is held by small depressions in the surface of the polishing pad, when areas become worn, the slurry is no longer effectively held, and the polishing process suffers.

In order to restore the polishing pad to its optimum condition, various "conditioning" processes are employed in the prior art. Conditioning is a process by which the polishing pad is treated with a conditioning device to increase its lifetime. Most conditioning processes use a conditioning head pressed against the polishing pad to accomplish the conditioning. The conditioning head usually includes an abrasive surface, for example, diamonds embedded in a nickel plating. The abrasive surface of the conditioning head is driven against the polishing pad in much the same way as the semiconductor wafers are during polishing. The conditioning head removes excess particulate material from the surface of the polishing pad and roughens (i.e. places new depressions) in worn areas, thereby restoring the polishing pad to its optimum condition.

There are two basic types of conditioning processes: in-situ and ex-situ. In-situ conditioning processes condition the polishing pad at the same time that wafers are being polished. Essentially, two separate heads, one for polishing and one for conditioning, overlie the polishing pad simultaneously. An ex-situ conditioning process takes place in between wafer polishings. In an ex-situ-process, only one of the conditioning and polishing heads overlies the polishing pad at any one time. Generally, in-situ conditioning processes are favored because valuable polishing time is not wasted on conditioning. However, in-situ processes often experience problems because particulate material removed by the conditioning head often strays onto the polishing portion of the polishing pad, thereby interfering with the polishing process.

One of the main problems experienced by both in-situ and ex-situ conditioning processes is a lack of consistency in the amount of pressure applied to the conditioning head during conditioning. The amount of pressure applied to the conditioning head is directly related to the amount of conditioning which is accomplished. Thus, the more pressure that is applied to the conditioning head, the more vigorous the conditioning process will be, and vice versa. Too much or too little conditioning can result in decreased lifetime for polishing pads. Therefore, there is currently a need for a conditioning process which accurately and efficiently controls the amount of conditioning which the polishing pad experiences.

FIG. 1 shows a prior art conditioning device generally designated by reference numeral 100. The device 100 is an example of an ex-situ conditioning device, however, the following explanation applies equally as well to an in-situ conditioning device. The device 100 includes a polishing platen 110, a polishing pad 140, a conditioning head 130, conditioner 170, and a support arm 190. The conditioning head 130 is supported by a first rotatable shaft 137, which is rotated about axis $A_1$, by first drive motor 180. The polishing platen 110 is supported by a second rotatable shaft 120, which is rotated about axis $A_2$ by second drive motor 150. The conditioner 170 is held to the conditioning head 130 by a retaining member (not shown), such as bolts, glue, or magnets. Preferably, the conditioner 170 is held to the conditioning head with bolts, so that the conditioner 170 may be easily changed or replaced. The support arm 190 performs a dual function, it serves to rotate the conditioning head 130 onto and off of the polishing pad 140, and it also serves to force the conditioning head 130 against the polishing pad 140. Since the device 100 is an ex-situ device, the conditioning head 130 only overlies the polishing pad 140 when conditioning is required. The conditioning head 130 is rotated on and off of the polishing pad 140 by rotation of the support arm 190 about axis $A_3$. If the device 100 were in-situ, the conditioning head 130 would overly the polishing pad at all times, even during polishing.

The forcing of the conditioning head 130 against the polishing pad is accomplished by displacing a first shaft portion 192 of the support arm 190 in the vertical direction. Note that the first shaft portion 192 lies inside a second shaft portion 194 of the support arm 190. The second shaft portion 194 allows the first shaft portion 192 to be displaced within the second shaft portion 194 to thereby force the conditioning head 130 against the polishing pad 140. A control circuit (not shown) controls the vertical displacement of the first shaft portion 192 in the holder 194. This displacement of the first shaft portion 192 causes the conditioning head 130 to either be pressed against the polishing pad 140 or removed from it, depending on the direction of displacement. For example, an upward movement of the first shaft portion 192 moves the conditioning head 130 away from the polishing pad 140, whereas a downward movement moves the conditioning head 130 closer to the polishing pad 140. The amount of displacement directly controls the amount of conditioning which the polishing pad 140 will experience. Thus, as the conditioning head 130 is pressed more firmly against the polishing pad 140, more particles are cleared away and more depressions are formed in the polishing pad. In order to optimize the conditioning process, it is necessary to accurately control the force applied to the conditioning head 130.

SUMMARY OF THE INVENTION

The present invention is a method and apparatus for improving the process for conditioning a polishing pad. A stationary support arm and a force control mechanism accomplish the conditioning. The force control mechanism is attached to the conditioning head and is used to raise and lower the head with respect to the polishing pad. The force control mechanism comprises a force control mechanism, such as a piston or magnet, which accurately controls the amount of force applied to the conditioning head.

The above and other advantages and features of the present invention are better understood from the following detailed description of the preferred embodiments of the invention which is provided in connection with the accompanying drawings.

DETAILED DESCRIPTION

Since the prior art conditioning devices use a "translated" force (i.e. the force of the displacement of a shaft translated through a support arm to the conditioning head) to press the conditioning head against the polishing pad, they are often not consistent in their conditioning of the polishing pad. The present inventors have discovered that the pressure applied to the conditioning head can be more accurately controlled by a force control mechanism coupled to the conditioning head. By controlling the conditioning head pressure directly, a more consistent conditioning process can be achieved.

The present invention comprises an apparatus and method for conditioning a polishing pad for polishing semiconductor wafers. The present invention utilizes a force control mechanism coupled to a conditioning head to apply the head to the polishing pad in a consistent manner. According to a first embodiment, the force is controlled by a hydraulic or pneumatic mechanism attached to the conditioning head. In a second embodiment, the force is controlled by oppositely polarized magnets located in the conditioning head and the polishing platen, respectively.

Figure 1:
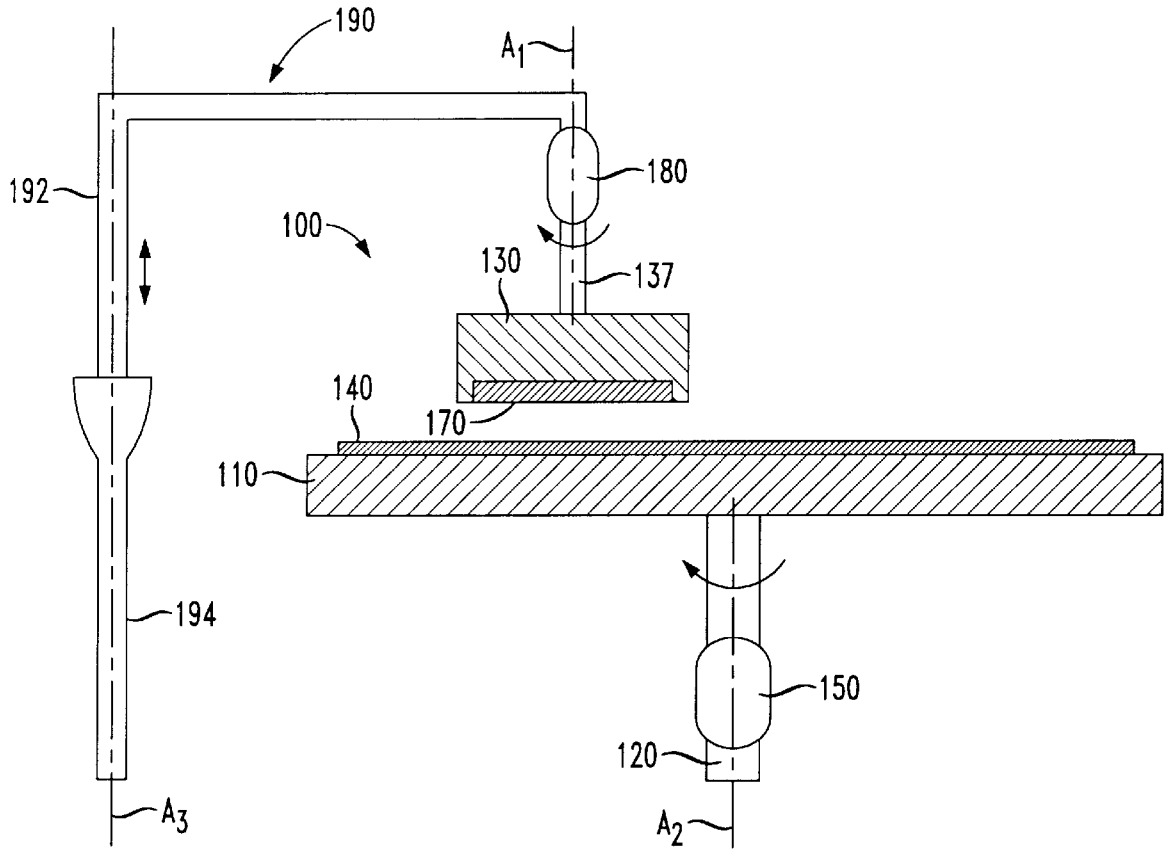
FIG. 1 PRIOR ART
FIG. 1 illustrates a prior art conditioning apparatus.
Figure 2:
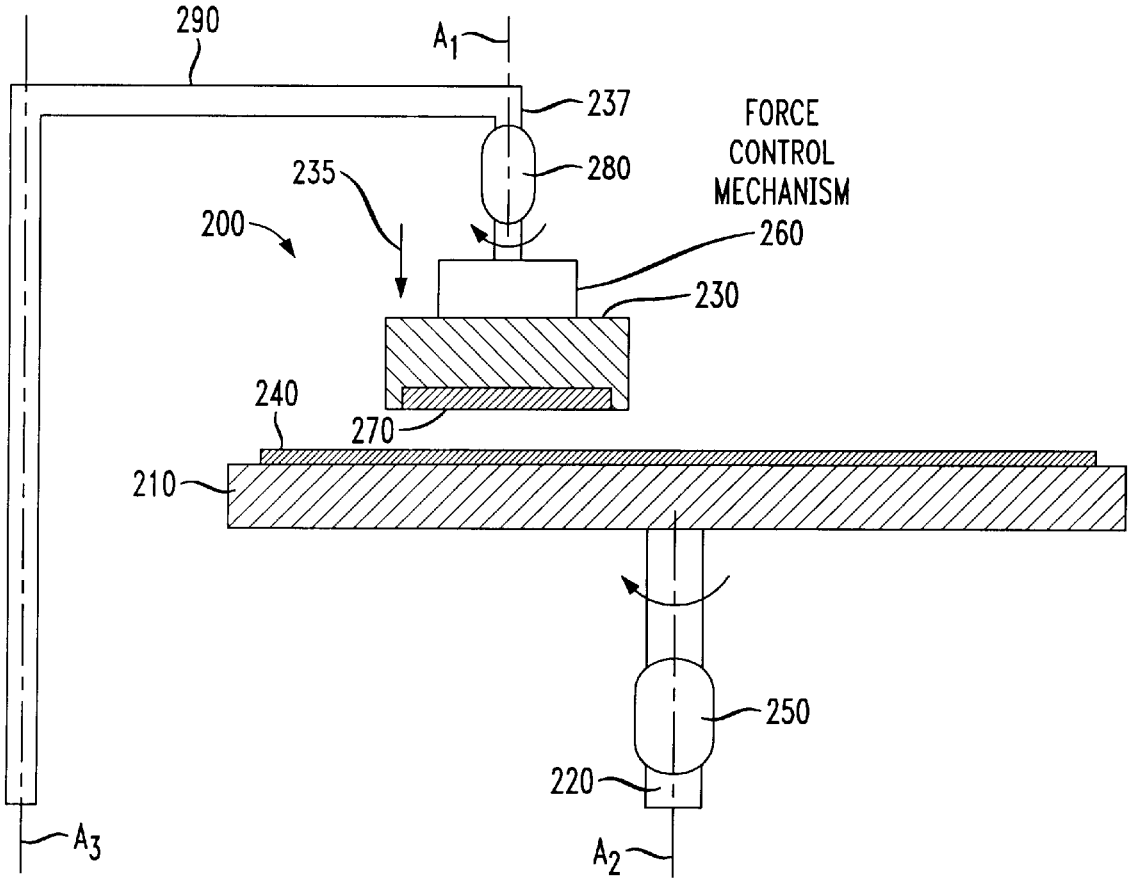
FIG. 2 illustrates the present invention where a force control mechanism is designated generically.
Figure 3:
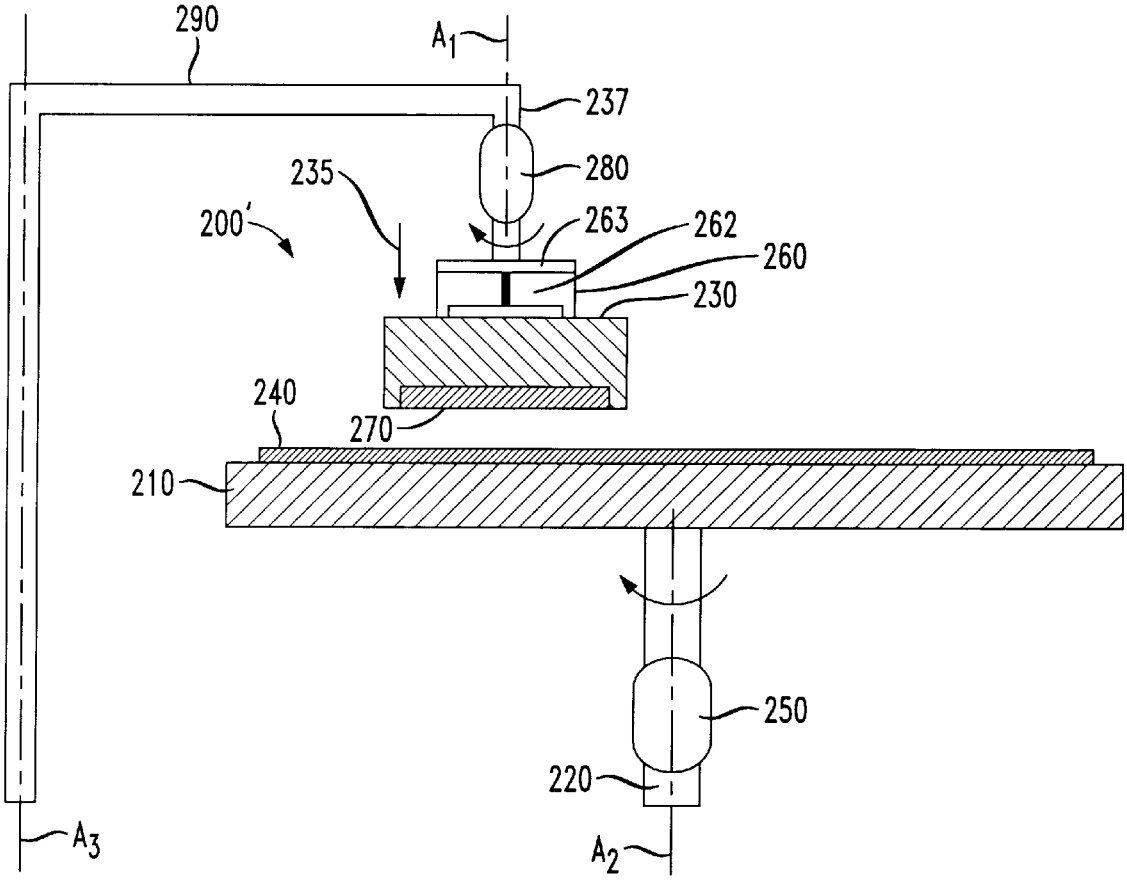
FIG. 3 illustrates a first embodiment of the present invention.
Figure 4:
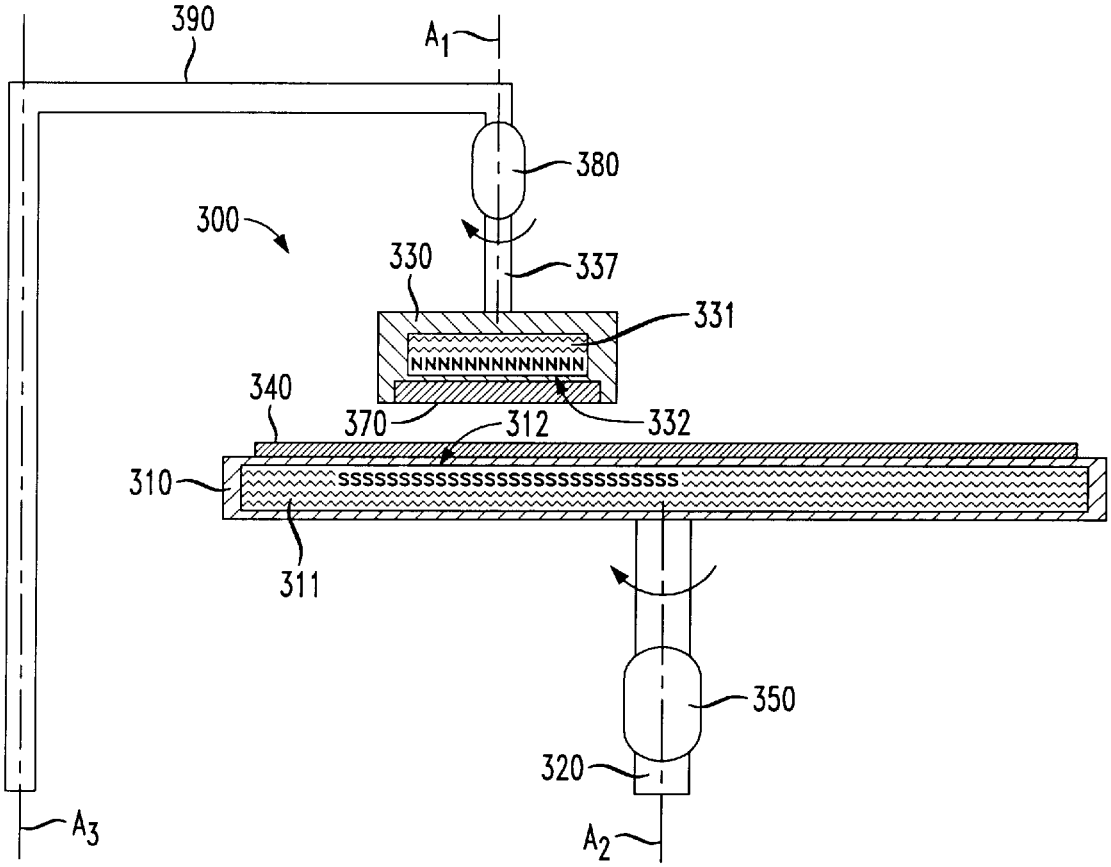
FIG. 4 illustrates a second embodiment of the present invention.

FIG. 2 shows a conditioning device 200 according to the present invention. For the ease of discussion, the force control mechanism is designated generically by reference numeral 260. Examples of the pneumatic/hydraulic and magnetic force control mechanisms are shown in FIGS. 3–4. The conditioning device 200 includes a polishing platen 210, a polishing pad 240, a conditioning head 230, a support shaft 290, and a force control mechanism 260. The conditioning head 230 is supported by a first rotatable shaft 237, which is rotated about axis $A_1$ by first drive motor 280. The polishing platen 210 is supported by a second rotatable shaft 220, which is rotated about axis $A_2$ by second drive motor 250. A conditioner 270 for conditioning the surface of the polishing pad 240 may be formed of a disc of diamond impregnated nickel material. The conditioner 270 is held to the conditioning head 230 by a retaining member (not shown), such as bolts, glue, or magnets. Preferably, the conditioner 270 is held to the conditioning head 230 with bolts, so that various conditioners (e.g. brushes, discs made of different materials) may be easily inserted and replaced. The force control mechanism 260 is coupled to the conditioning head 230 so that force created therein propels the conditioning head against the polishing pad 240. In contrast to the prior art conditioning device 100 shown in FIG. 1, the conditioning device 200 includes a stationary support shaft 290 which does not allow displacement in the vertical direction. The force control mechanism 260 instead controls the force exerted on the conditioning head 230.

The operation of the conditioning device 200 is next described with respect to a ex-situ conditioning process, however, conditioning processes as according to the present invention could also be performed in-situ. Typically, in an ex-situ conditioning process, the conditioning head 230 is kept off the polishing pad 240 until conditioning is required, at which point the conditioning head is brought into contact with the polishing pad to perform the conditioning. The support shaft 290 is rotatable about an axis $A_3$ to move the conditioning head 230 on and off the polishing pad 240. Thus, in the present invention, when conditioning of the polishing pad 240 is required, the conditioning head 230 is rotated to a position over the polishing pad 240 by rotation of the support arm 290 about axis $A_3$. When the conditioning head 230 lies overtop the polishing pad 240, as shown in FIG. 2, the conditioning process is ready to begin. At this point a control circuit (not shown) sends control signals to the force control mechanism 260 to cause the force control mechanism to create a downward force 235 on conditioning head 230. This downward force 235 pushes the conditioner 270 of head 230 into contact with the rotating polishing pad 130 to begin the conditioning process. The abrasive surface of the conditioner 270 (e.g. diamond impregnated nickel) causes extraneous particles located on the surface of the polishing pad 240 to be stripped away. The abrasive surface of the conditioner 270 also creates depressions in areas of the polishing pad 240 which are worn. The creation of these depressions allows the polishing pad 240 to hold more polishing slurry (not shown) and to perform improved polishing. Although diamond impregnated nickel is a preferred material for the conditioner 270, other materials such as silicon carbide and the like are also usable. Further, alternatively to the diamond impregnated disc described above, a brush or other abrasive object may also be used for conditioner 270. In fact, any abrasive equivalent means known to those skilled in the art may be used for conditioner 270.

In order to condition the entire surface of the polishing pad 240, the polishing platen 210 is displaced in different directions while it is rotating by movement of rotatable shaft 220. Once conditioning of the entire polishing pad 240 has been completed, control signals are sent to the force control mechanism 260 to create an upward force to draw the conditioning head 230 away from the polishing pad 240. Finally, the conditioning head 230 is rotated away from the polishing pad 240 by rotation of support shaft 290 so that wafers can again be polished.

The force control mechanism 260 can be formed in many different ways, and by many different combinations of elements. For example, according to a first embodiment of the present invention, the mechanism 260 comprises a pneumatic or hydraulic device such as a piston. In a second embodiment, the force control mechanism 260 comprises a magnetic device.

FIG. 3 shows a first embodiment of the present invention where the force control mechanism 260 comprises a pneumatic or hydraulic mechanism 262. The device 200' shown in FIG. 3 has similar components to the device 200 shown in FIG. 2, and like reference numerals denote like elements. In order to force the conditioning head 230 against the polishing pad 240, the mechanism 262 creates a force which is translated directly to the conditioning head. The forcing of air or hydraulic fluid into chamber 263 causes a portion of the mechanism 262 to force conditioning head 230 down onto the polishing pad 240. Conversely, the removal of such air or fluid causes the conditioning head 230 to retract away from the polishing pad 240. A control system (not shown) sends control signals to the mechanism 262 in order to control the operation of the mechanism 262. In this way, the pressure applied to the conditioning head 230 is accurately controlled, and the consistency of the conditioning process is significantly increased.

The force control mechanism can also comprise a set of oppositely polarized magnetic regions. FIG. 4 shows such a conditioning device 300 according to a second embodiment of the present invention. The device 300 has similar components to the device 200 shown in FIG. 2, and like reference numerals denote like elements. The device 300 comprises first 331 and second 311 magnetic regions defining a force control mechanism. A portion 332 of the first magnetic region 331 which lies directly above a conditioning head 330 is of a specific polarity (e.g. north), and a portion 312 of the second magnetic region 311 which lies directly below a polishing pad 340 is of a specific polarity which is opposite to that of the first portion (e.g. south). The opposing polarity portions 332, 312 cause the conditioning head 330 and the polishing platen 310 to be attracted to one another. A current source (not shown) varies the current through magnetic regions 331,311 in order to control the degree of attraction. By controlling the degree of attraction between the magnetic regions, the force exerted on conditioning head 330 can be effectively controlled, and the consistency of the conditioning process can be improved.

Although the above discussion with reference to FIG. 4 emphasized magnets which were located in the conditioning head and the polishing platen, it should be noted that this is not the only method of implementing the second embodiment. The invention may also be constructed with a single magnetic region in the conditioning head or polishing platen, with the opposing region being made of a magnetically responsive material, such as steel. Similarly, other embodiments can be constructed where both the oppositely polarized magnetic regions are located in one or the other of the conditioning head and the polishing platen.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. An apparatus for conditioning a polishing pad comprising:

a conditioning device;

a force control mechanism for applying a force directly to the conditioning device to cause the conditioning device to contact the polishing pad; and, a support structure for supporting the conditioning device and force control mechanism above the polishing pad, wherein the force control mechanism comprises a magetic control mechanism.

2. The apparatus of claim 1, wherein the magnetic control mechanism comprises a set of oppositely polarized magnetic regions.

3. The apparatus of claim 2, wherein the attracting force between the set of oppositely polarized magnetic regions is controlled by controlling a current in each magnetic region.

4. The apparatus of claim 1, wherein the conditioning device comprises one of the group consisting of a disc and a brush.

5. The apparatus of claim 4, wherein the conditioning device is an abrasive diamond disc.

6. An apparatus for polishing a workpiece comprising:

a polishing pad for polishing a workpiece;

a conditioning device;

a force control mechanism for applying a force directly to the conditioning device to cause the conditioning device to contact the polishing pad; and, a support structure for supporting the conditioning device and force control mechanism above the polishing pad, wherein the force control mechanism comprises a magnetic control mechanism.

7. The apparatus of claim 6, wherein the magnetic control mechanism comprises a set of oppositely polarized magnetic regions.

8. The apparatus of claim 7, wherein the attracting force between the set of oppositely polarized magnetic regions is controlled by controlling a current in each magnetic region.

9. The apparatus of claim 6, wherein the conditioning device comprises one of either a disc or a brush.

10. The apparatus of claim 9, wherein the conditioning device is an abrasive diamond disc.

11. An apparatus for conditioning a polishing pad comprising:

a conditioning pad;

a magnetic force control mechanism for applying a force directly to the conditioning device to cause the conditioning device to contact the polishing pad; and, a support arm for supporting the conditioning device and force control mechanism above the polishing pad.

12. A method of conditioning a polishing pad comprising the steps of:

supporting a conditioning device over a polishing pad;

applying a force directly against the conditioning device to force the conditioning device against the polishing pad; and, controlling the amount of force applied by the conditioning device against the polishing pad while conditioning the polishing pad, wherein the amount of force applied by the conditioning device is controlled by a magnetic control mechanism.

13. The method of claim 12, wherein the magnetic control mechanism comprises a set of oppositely polarized magnets.

14. The method of claim 13, wherein the attracting force between the set of oppositely polarized magnetic regions is controlled by controlling a current in each magnetic region.

15. The method of claim 12, wherein the conditioning device comprises one of either a disc or a brush.

16. The method of claim 15, wherein the conditioning device is an abrasive diamond disc.

* * * * *